US007527397B2

(12) United States Patent
Li

(10) Patent No.: US 7,527,397 B2
(45) Date of Patent: May 5, 2009

(54) SOLID STATE LIGHTING PACKAGE STRUCTURE

(76) Inventor: Chia-Mao Li, 235 Chung - Ho Box 8-24, Taipei (TW)

( * ) Notice: Subject to any disclaimer, the term of this patent is extended or adjusted under 35 U.S.C. 154(b) by 70 days.

(21) Appl. No.: 11/526,909

(22) Filed: Sep. 26, 2006

(65) Prior Publication Data

US 2008/0074883 A1 Mar. 27, 2008

(51) Int. Cl.
*F21V 29/00* (2006.01)

(52) U.S. Cl. ..... 362/294; 362/240; 362/249; 362/800

(58) Field of Classification Search ..... 362/800, 362/236–245; 361/770, 807, 809
See application file for complete search history.

(56) References Cited

U.S. PATENT DOCUMENTS 5,036,248 A * 7/1991 McEwan et al. ..... 313/500
5,567,036 A * 10/1996 Theobald et al. ..... 362/485
5,947,588 A * 9/1999 Huang ..... 362/235
6,019,493 A * 2/2000 Kuo et al. ..... 362/335
6,036,336 A * 3/2000 Wu ..... 362/249
6,184,628 B1 * 2/2001 Ruthenberg ..... 315/185 R
6,685,339 B2 * 2/2004 Daughtry et al. ..... 362/251
6,774,584 B2 * 8/2004 Lys et al. ..... 315/362
6,787,999 B2 * 9/2004 Stimac et al. ..... 315/51
6,799,864 B2 * 10/2004 Bohler et al. ..... 362/236
6,929,384 B2 * 8/2005 Watanabe et al. ..... 362/252
7,207,695 B2 * 4/2007 Coushaine et al. ..... 362/240
7,226,189 B2 * 6/2007 Lee et al. ..... 362/294
7,255,460 B2 * 8/2007 Lee ..... 362/294
7,396,146 B2 * 7/2008 Wang ..... 362/294
2007/0165408 A1 * 7/2007 Li ..... 362/294
2007/0230186 A1 * 10/2007 Chien ..... 362/294
2007/0236935 A1 * 10/2007 Wang ..... 362/294
2008/0158887 A1 * 7/2008 Zhu et al. ..... 362/294

* cited by examiner

*Primary Examiner*—Sandra L. O'Shea
*Assistant Examiner*—Gunyoung T. Lee

(57) ABSTRACT

The present invention discloses a solid state lighting package structure that breaks through the present small power packaging method to achieve the required power for lighting and overcome the heat and light issues, and uses a good heat sink and thermal conducting structure to quickly dissipate the heat produced by a chip to the outside. Special symmetric chip pattern and optical structure can evenly and efficiently guide the light out and select different color chips to meet the requirements for different color lights. The structure can be combined with a lamp easily, such that the solid state lighting can be applied for illumination easily and quickly.

1 Claim, 10 Drawing Sheets

SOLID STATE LIGHTING PACKAGE STRUCTURE

BACKGROUND OF THE INVENTION

1. Field of the Invention

This invention relates to a solid state lighting package structure, and more particularly to a solid state lighting package structure capable of improving the heat conduction of a solid state light source by using a special symmetric chip pattern to conduct heat evenly to a heat sink, and the heat sink is made of a material with a good thermal conductivity, and the heat of the light source can be conducted through its contact with the heat sink, so as to enhance the thermal conductivity of the solid state package, and a special symmetric chip pattern and an optical structure can evenly and efficiently guide the light out and select different color chips to meet the requirements of different color lights, and the structure can be combined with a lamp easily, such that the solid state lighting can be applied for illumination in an easy and quick manner.

2. Description of the Related Art

In a traditional solid state light source (LED) packaging method, the thermal conduction performance is poor and cannot improve the power of a single chip. If sufficient intensity of illumination is needed, it is necessary to concentrate the brightness of several chips. After a plurality of chips are concentrated, the brightness can be improved, but the efficiency of the thermal conduction cannot be improved, and thus the heat of the chips is much greater than the heat around the chips, and the heat is unevenly distributed and concentrated on the chips and cannot be dissipated to the outside. Since the efficiency of thermal conduction is low, the chip cannot stand a larger power. Although the lamp obtains higher brightness by the plurality of chips, the chips cannot be combined with a general lamp easily. Further, the required brightness can be obtained by concentrating several chips, but the effect of "lighting with a plurality of points" is different from the general lighting, and thus it is very difficult to develop and promote the solid state lighting.

SUMMARY OF THE INVENTION

The objective of this invention is to provide a solid state lighting package structure that breaks through the present small power packaging method to achieve the required power for lighting and overcome the heat and light issues, and uses a good heat sink and a thermal conducting structure to quickly dissipate the heat produced by the chips to the outside. Special symmetric chip pattern and optical structure can evenly and efficiently guide the light out and select different color chips to meet the requirements for different color lights. The structure can be combined with a lamp easily, such that the solid state lighting can be applied for illuminations easily and quickly.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
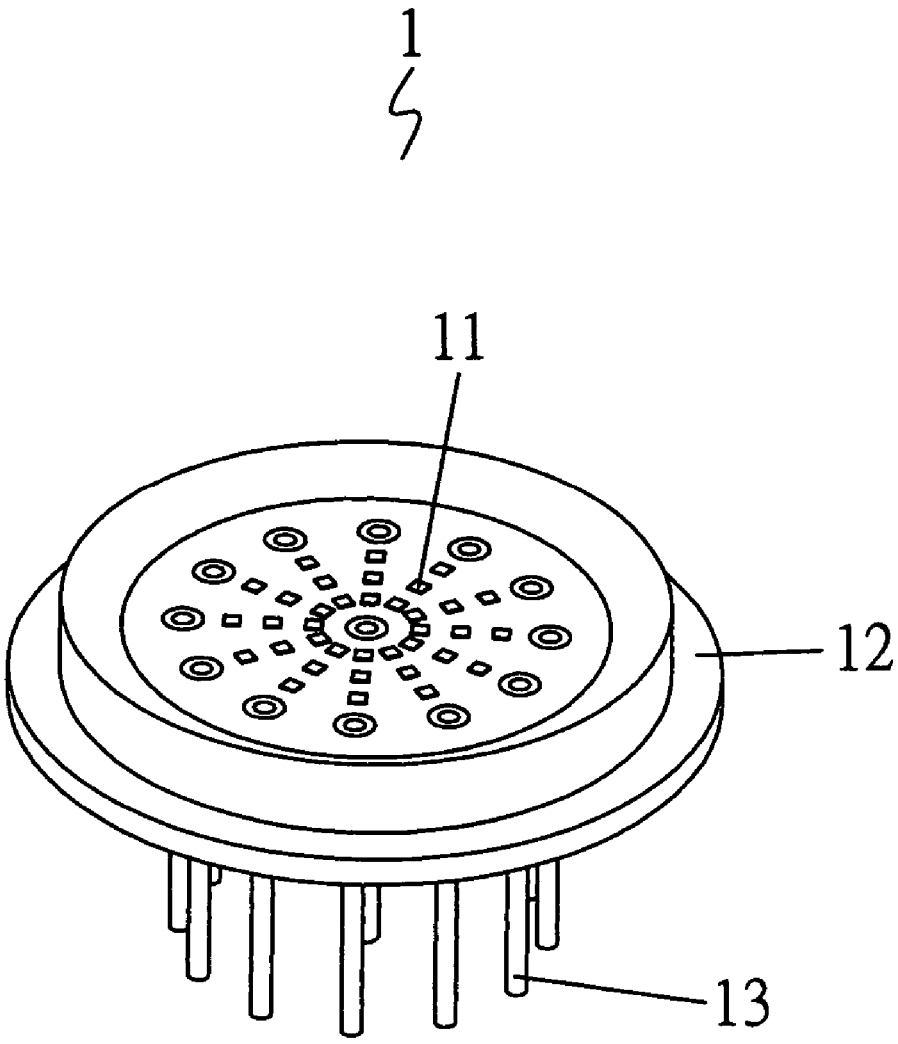
FIG. 1 is a perspective view of a solid state lighting package structure of the present invention.

In the detailed description of the preferred embodiments, it should be noted that like elements are indicated by the same reference numerals throughout the disclosure.

Figure 2:
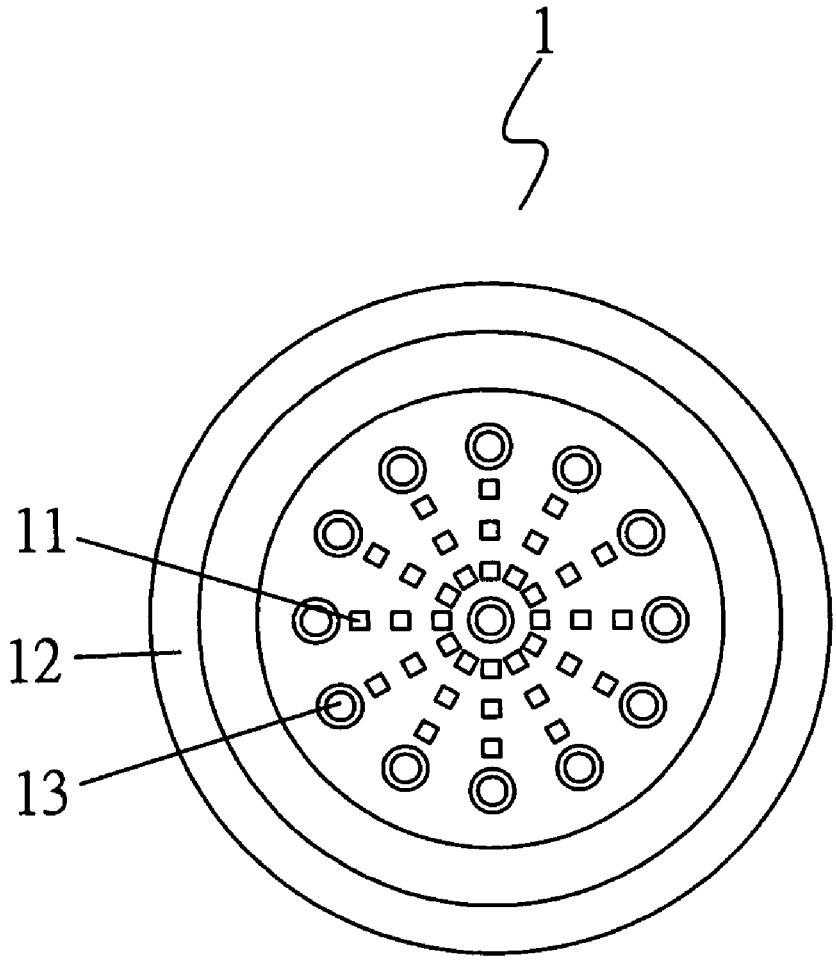
FIG. 2 is a top view of a solid state lighting package structure of the present invention.

Referring to FIGS. 1 and 2 for a perspective view and a top view of a solid state lighting package structure in accordance with the present invention, the solid state lighting package structure 1 comprises a plurality of power supply pins 13 disposed at the middle and around the circular periphery of the solid state lighting package structure 1, and twelve sets of LED chips 11 arranged in a radiating shape or a geometric shape among the power supply pins 13 and packages the LED chips 11 in a heat sink 12, and the heat sink 12 has a very large heat capacity with respect to the chip and can absorb a large quantity of heat of the LED chips 11, such that the heat produced by the LED chip 11 operated at a high power can be conducted quickly to the heat sink 12. The heat sink 12 at its bottom includes a plurality of power supply pins 13. The LED chips 11 are arranged in a radiating shape or a geometric shape to avoid the heat sources from being overcrowded and provide an even heat dissipation for evenly dispersing the heat, quickly conducting the heat and maintaining a lower temperature, so as to improve the thermal conductivity and prevent possible damages to the chips and conducting wires caused by the thermal stress. Further, the radiating shaped or geometric shaped symmetric pattern can emit light beams evenly, and the symmetric pattern in a radiating shape or a geometric shape can reflect the side lights of a light source to the front from an oblique surface of the internal periphery of the heat sink 12, so that the lights can be concentrated and the intensity can be higher. The chips can be arranged symmetrically in different colors such as red, green and blue, such that different chips in the same package can emit lights of different colors or can simultaneously emit a light with mixed colors, and the symmetric pattern can provide even lights.

Figure 3:
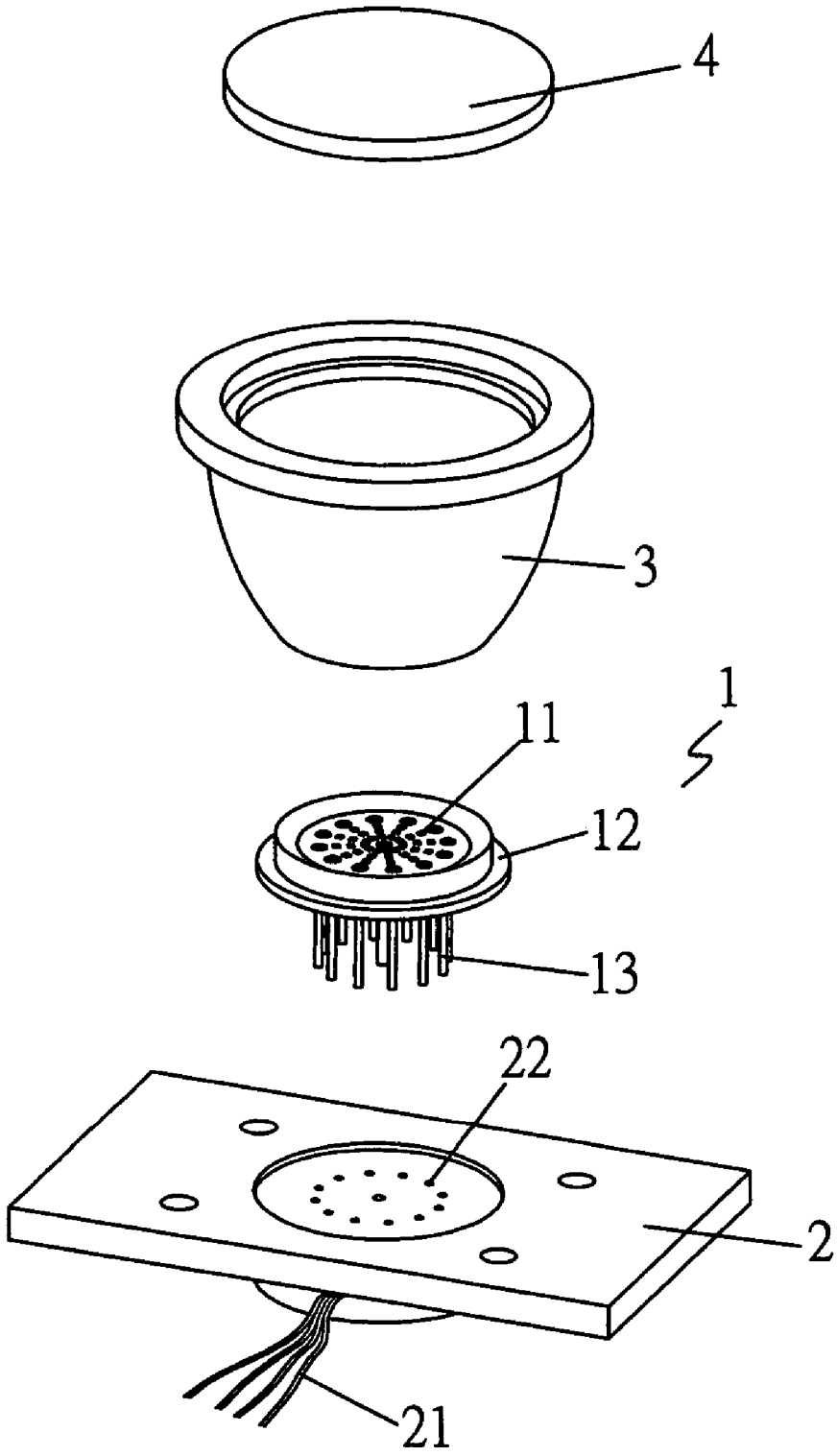
FIG. 3 is an exploded view of a solid state lighting package structure of the present invention.
Figure 4:
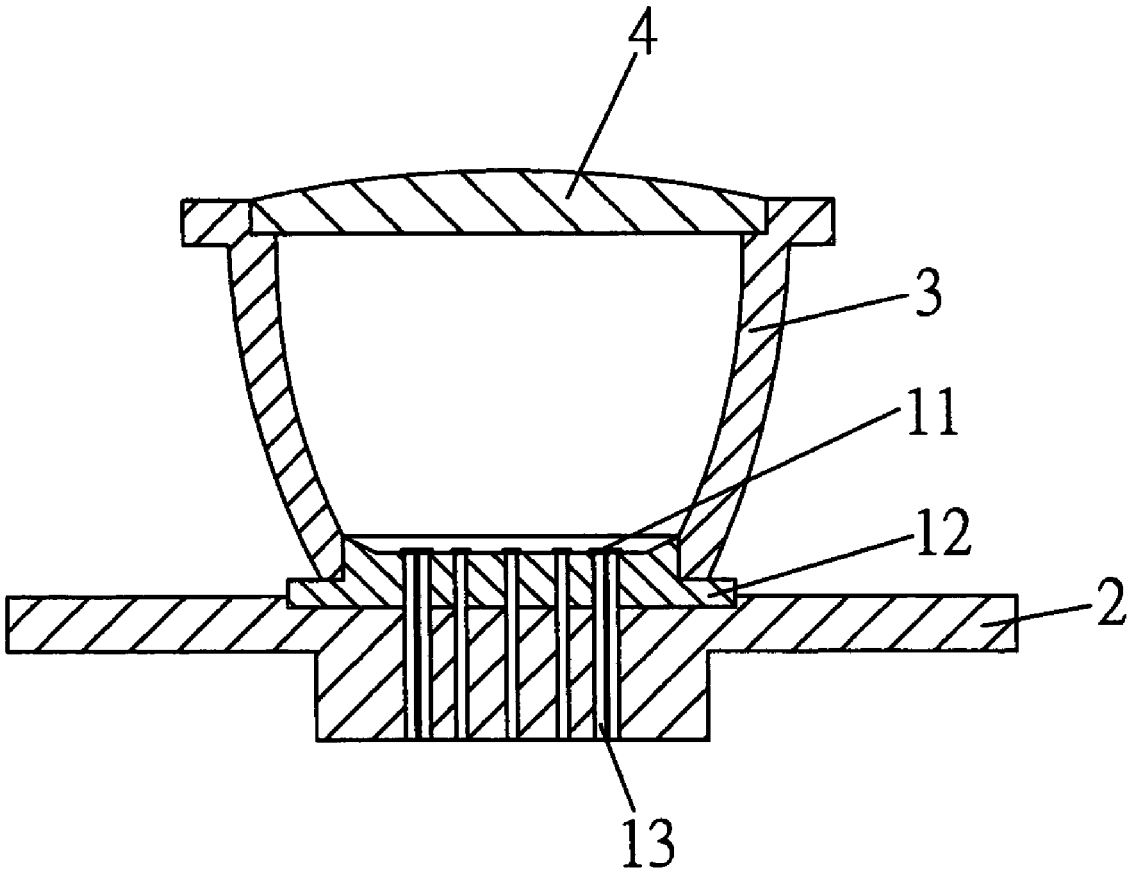
FIG. 4 is a cross-sectional view of a solid state lighting package structure in accordance with a preferred embodiment of the present invention.
Figure 5:
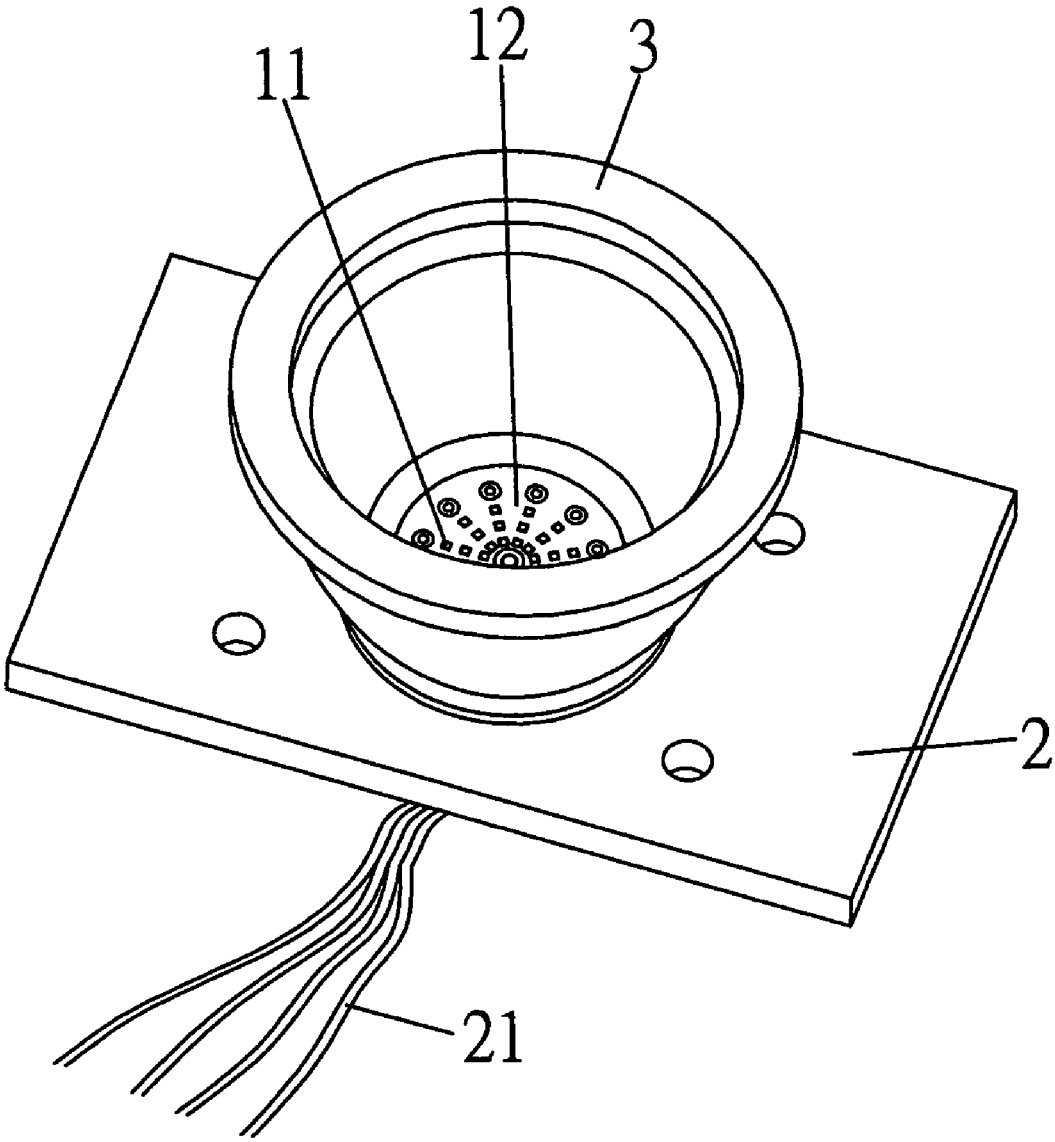
FIG. 5 is a perspective view of a solid state lighting package structure in accordance with a preferred embodiment of the present invention.

Referring to FIGS. 3 to 5 respectively for an exploded view, a cross-sectional view and a perspective view of a solid state lighting package structure in accordance with a preferred embodiment of the present invention, the solid state lighting package structure 1 is applied to a lamp, and the structure 1 installs a heat sink 12 to a heat conducting base 2, and the heat sink 12 can be embedded into the heat conducting base 2 to increase the contact area of the heat sink 12 and the heat conducting base 2, such that the heat sink 12 can conduct heat to the heat conducting base 2 more quickly than a heat sink 12 with a larger area and volume. In other words, such heat sink 12 can provide a larger heat capacity, so that the overall structure can have a significant effect on lowering the temperature of chips. Another advantage of embedding the heat sink 12 into the heat conducting base 2 is that the mechanical strength can be enhanced to securely embed the heat sink 12 onto the heat conducting base 2 to prevent the heat sink 12 and the heat conducting base 2 from being shaken, collided or fallen apart, and the heat conducting base 2 together with the heat sink 12 can enhance the insulation of the overall structure. The heat conducting base 2 could be a circular, square, or other geometric shaped structure, and the power supply pins 13 under the heat sink 12 are inserted into a plurality of insert holes 22 of the heat conducting base 2 and connected to an electric wire 21, and the lampshade cup body 3 is installed onto the heat sink 12, and a glass lens 4 is inlaid onto the top of the lampshade cup body 3, such that when the lamp is in use, the heat of the LED chip 11 can be conducted quickly through the heat sink 12 to the heat conducting base 2 with a large contact area. Since the chips are arranged in a radiating shape, the heat can be dissipated evenly, so as to give a better thermal conduction performance.

Figure 6:
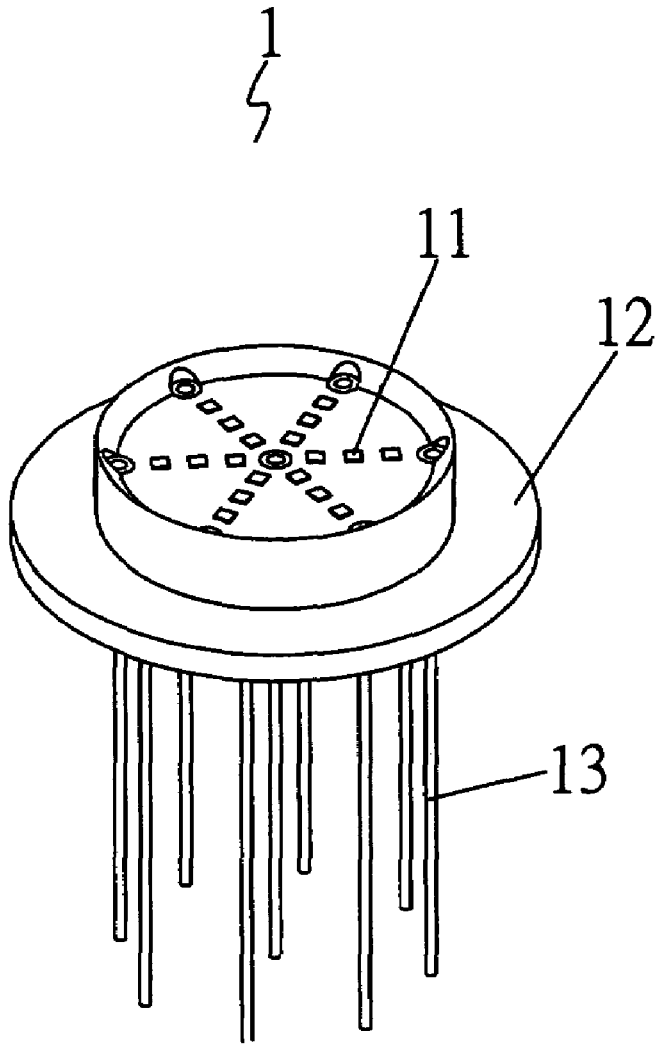
FIG. 6 is a perspective view of another package of a solid state lighting package structure in accordance with the present invention.
Figure 7:
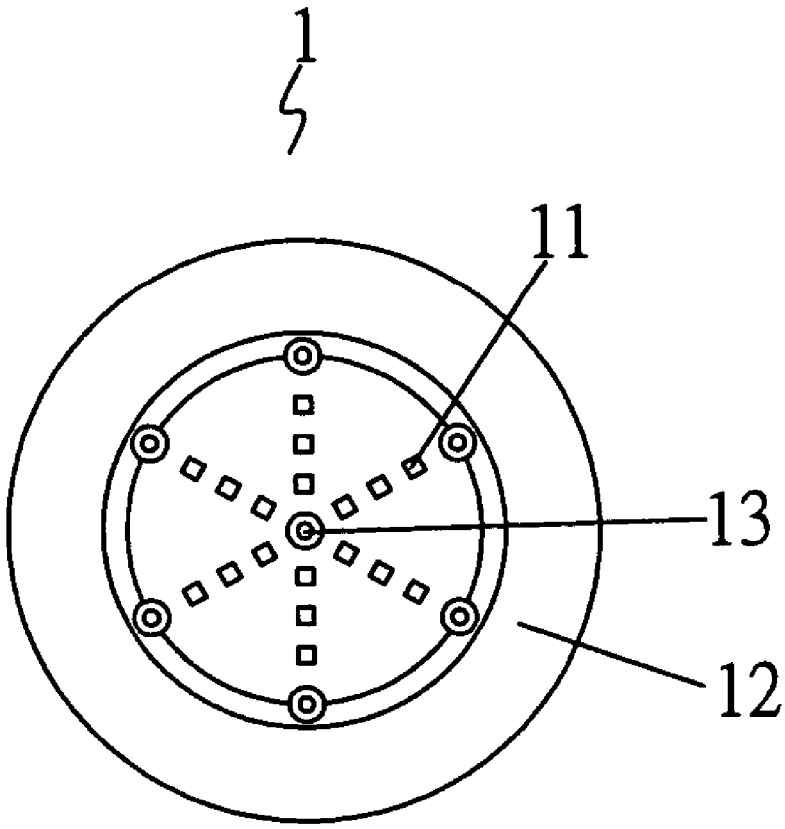
FIG. 7 is a top view of another package of a solid state lighting package structure in accordance with the present invention.
Figure 8:
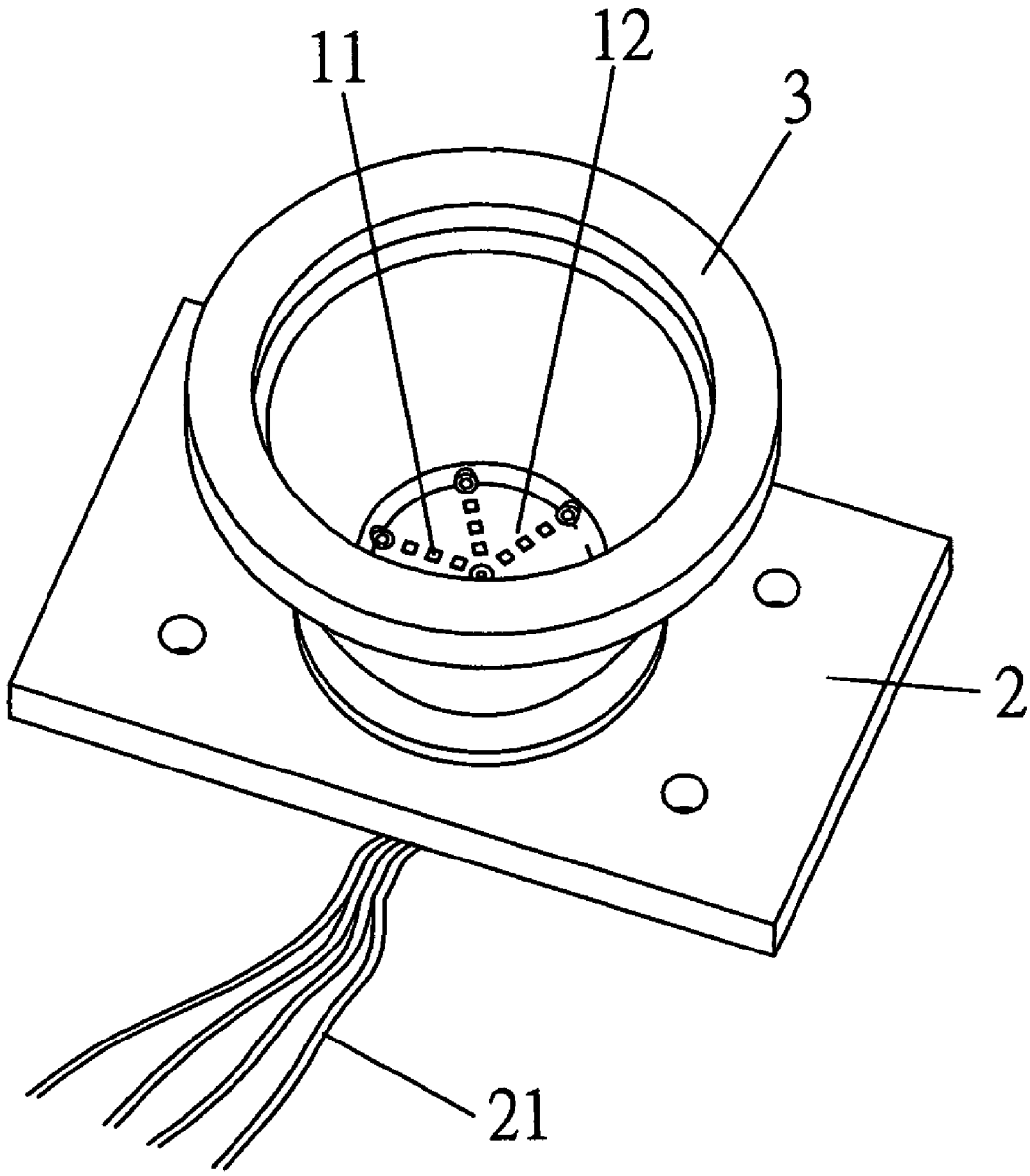
FIG. 8 is a perspective view of another package of a solid state lighting package structure in accordance with a preferred embodiment of the present invention.

Referring to FIGS. 6 to 8 respectively for a perspective view of another package of a solid state lighting package structure, a top view and a perspective view of a preferred embodiment of the present invention, the solid state lighting package structure 1 can be installed with a different number of LED chips 11 arranged in a radiating shape as needed, so that such structure 1 also have the advantages of providing a quick thermal conduction and a high intensity of light as well as producing a color light by mixing different colors.

Figure 9:
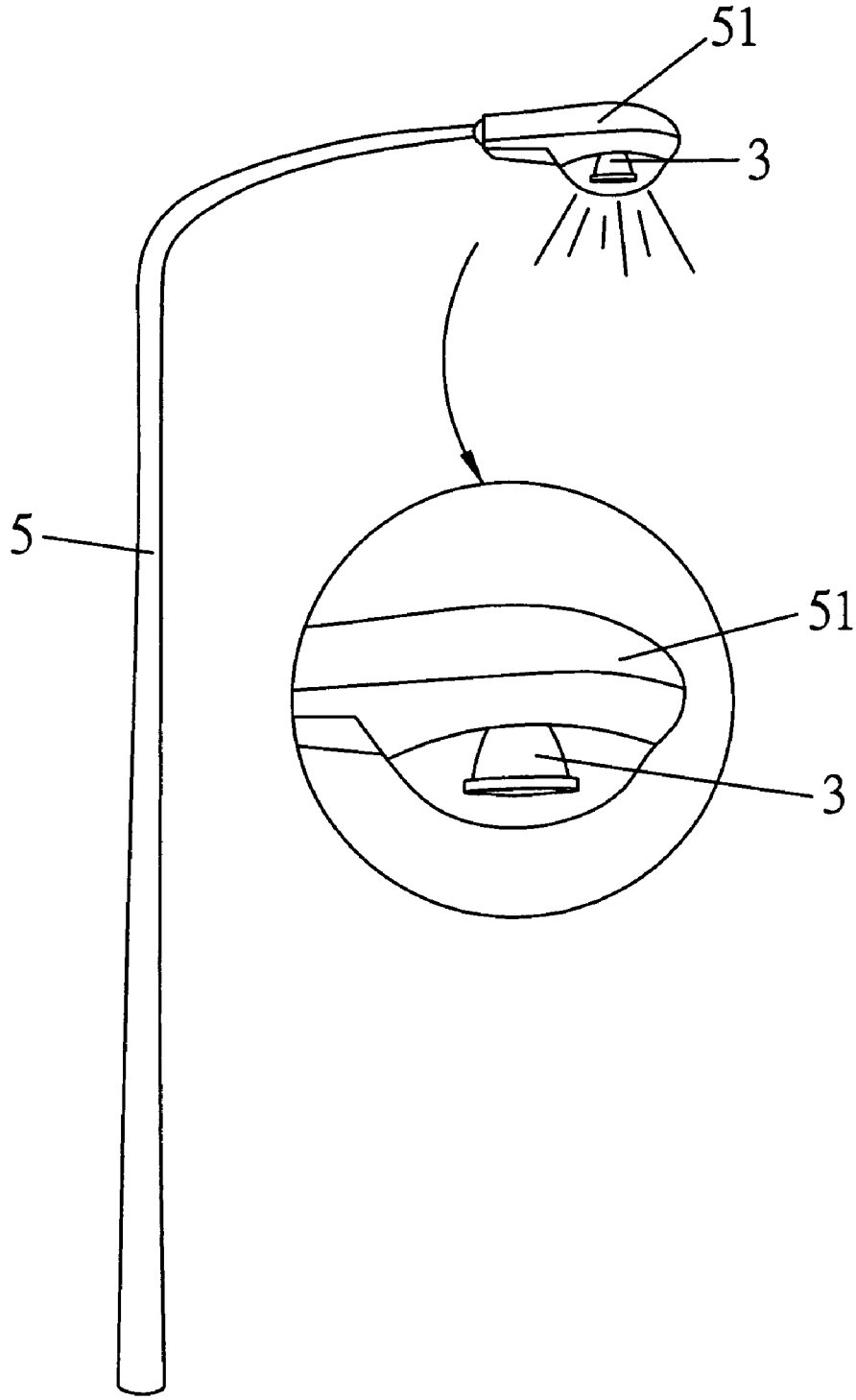
FIG. 9 is a schematic view of an application of a solid state lighting package structure in accordance with the present invention.
Figure 10:
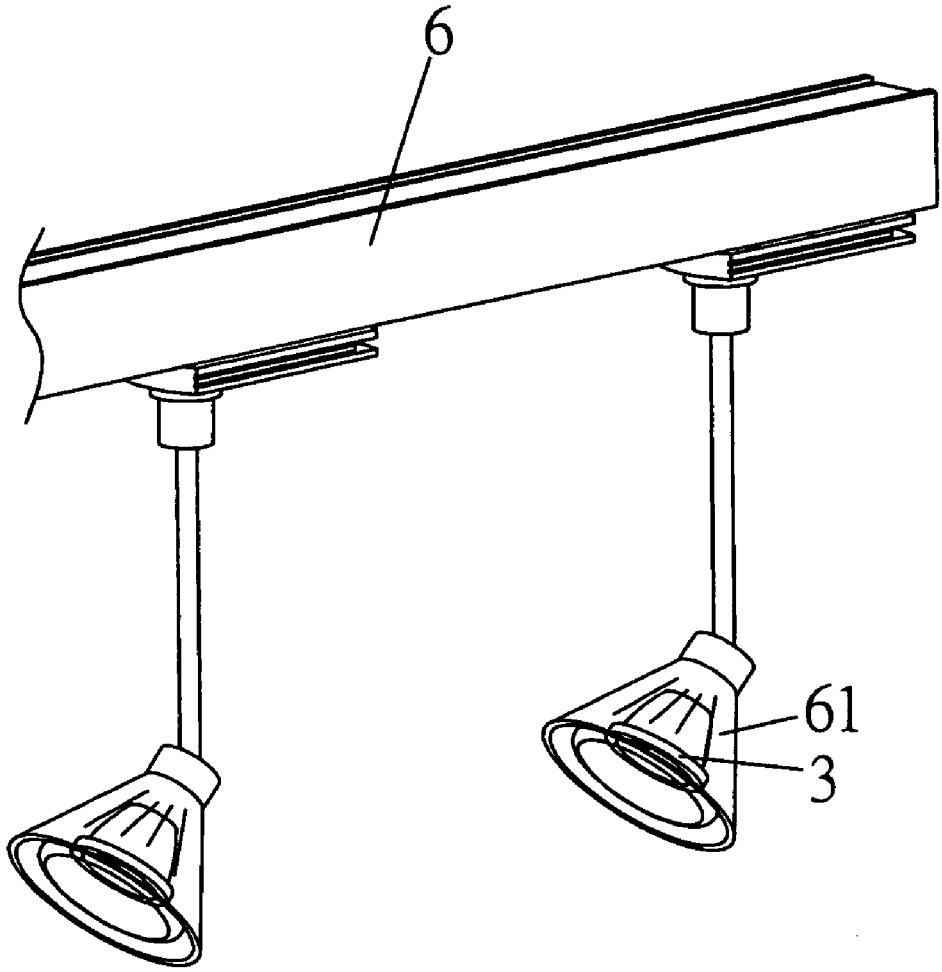
FIG. 10 is a schematic view of another application of a solid state lighting package structure in accordance with the present invention.

Referring to FIGS. 9 and 10 respectively for schematic views of two embodiments of the solid state lighting package structure in accordance with the present invention, the structure of the present invention can be applied to a general road lamp or various different decorating or illuminating lamps. In FIG. 9, the structure 1 is applied to a lamp post 5, and the solid state lighting package structure 1 installed in a traditional lamp shell 51 is used as a light source to replace a traditional lamp bulb that consumes much electric power and has a short life expectancy. In FIG. 10, the structure of the invention is applied to indoor decorating lamps, and the lamps are hung on a decorating lamp rack 6 and installed into a decorating lamp shell 61.

In summation of the description above, the major significance of the present invention resides on that the chips are packaged with a symmetric pattern in a radiating shape or a geometric shape onto the heat sink, such that heat can be dissipated evenly onto the heat sink to maximize the heat conduction efficiency and achieve the effects of enhancing the power of the chips and the evenness of the light. Unlike the traditional "lighting with a plurality of points", the solid state lighting package structure of the invention can be combined with a traditional lamp to give a broader range of application and improve its practicability.

To show the improvement and practicability of the present invention, a comparison with a prior art structure is given as follows:

The shortcomings of the prior art are listed below:

1. The prior art has a poor thermal conduction.
2. The life expectancy of the chip is shortened due to overheat.
3. Chips cannot stand high power.
4. The light emitting efficiency of the chip is low.
5. The intensity of illumination cannot be improved in direct proportion to the increased number of chips.
6. The chips are concentrated, such that the side lights of the light source are absorbed and off set with each other.
7. The thermal stress pulls the conducting wire connected to the chips, and thus the conducting wire may be broken easily.

The advantages of the present invention are listed as follows:

1. The invention has a high thermal conduction.
2. Good thermal conduction results in a long life expectancy of the chips.
3. The chips can stand a higher power.
4. The intensity of illumination can be improved with the same number of chips.
5. The light of the invention is symmetric and even.
6. Different colored light chips can be arranged in a symmetric pattern.
7. The loss of side lights of the light source can be reduced, and the side light emitted outward can be reflected to the front by the heat sink.
8. The structure of the invention can be combined with a lamp easily.
9. The effect of the thermal stress can be eliminated While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

In summation of the above description, the present invention herein enhances the performance than the conventional structure and further complies with the patent application requirements and is submitted to the Patent and Trademark Office for review and granting of the commensurate patent rights.

What is claimed is:

1. A solid state lighting package structure, comprising:

a heatconducting base (2) having a round recess with a plurality of insert holes (22) therein;

a heat sink (12) embedding into the heat conducting base (2);

a plurality of light emitting components (11) electrically coupled to and packaged in an upper side of the heat sink (12) as an illuminating light source; and the light emitting components being arranged as a symmetrical radiating pattern;

a plurality of power supply pins (13) extending downwards from a lower side of the heat sink (12) and made of a material with a good thermal conductivity for conducting heat of the light emitting components (11) to the outside and provided for connecting a power supply; in assembly, the power supply pins (13) being inserted into the insert holes in the round recess and being connected to electric wires;

a lampshade cup body (3) having a truncated round tapered shape for receiving the heat conducting base (2); the lampshade cup body being installed onto the heat sink (12), and a glass lens (4) being inlaid onto a top of the lampshade cup body (3), such that in use, heat of the light emitting components (11) will be conducted quickly through the heat sink (12) to the heat conducting base (2) with a large contact area; and wherein the light emitting components (11) in the radiating shaped symmetric pattern are electrically coupled to and packaged in the heat sink to evenly and quickly conduct the heat of the light emitting components to the heat sink (12), and the heat sink (12) together with the good thermal conductivity of the light emitting components (11) in a radiating shaped symmetric pattern eliminate the effects of thermal stress to the light emitting components (11) and the conducting wire (21), and the package in a radiating shaped symmetric pattern makes the light even and combines different color light emitting components in a symmetric pattern for providing different color tones; and wherein each of the light emitting component (11) is a light emitting diode chip.

* * * * *